United States Patent [19]

Beatty

[11] 4,156,270

[45] May 22, 1979

[54] OUTDOOR LIGHTING FIXTURE

[76] Inventor: J. Dean Beatty, 114 Simpson Dr., Rome, Ga. 30161

[21] Appl. No.: 788,298

[22] Filed: Apr. 18, 1977

[51] Int. Cl.[2] ..... F21V 33/00; H05B 33/02

[52] U.S. Cl. ..... 362/145; 362/221; 362/370; 362/457

[58] Field of Search ..... 362/145, 147, 151, 152, 362/146, 217, 221, 222, 223, 224, 226, 219, 225, 249, 368, 370, 432, 457; 52/28

[56] References Cited

U.S. PATENT DOCUMENTS

| | | | |
|---|---|---|---|
| 1,836,647 | 12/1931 | Crumpton | 362/145 |
| 2,346,315 | 4/1944 | Levy | 362/221 |
| 2,821,038 | 1/1958 | Gee | 52/28 X |
| 3,007,036 | 10/1961 | Mills, Jr. | 362/151 |
| 3,124,307 | 3/1964 | Hoskins et al. | 362/226 |
| 3,377,754 | 4/1968 | Russell | 52/28 X |

*Primary Examiner*—Gerald Goldberg
*Assistant Examiner*—Peter S. Wong
*Attorney, Agent, or Firm*—Jones, Thomas & Askew

[57] ABSTRACT

The outdoor lighting fixture is for attachment to a building structure and the like and includes an elongated shade for mounting along the building structure in an overhanging, cantilever relationship and the shade is folded to form a downwardly sloped section, and then folded again to form a vertical section which is parallel to and spaced from the building side surface. A series of lamp sockets are mounted to the lower surface of the shade adjacent the upper fold and elongated tubular fluorescent lamps are supported by the plugs. An elongated electrical wire housing is mounted to the lower surface of the shade immediately adjacent the sockets and functions to support the electrical wires of the light fixture and to rigidify the shade, and a plurality of elongated support braces extend from the edge of the shade which is attached to the building out to the fold at the sloped section and are rigidly attached to the shade for rigidifying the shade. The fluorescent lamps are insulated with external concentric protective tubes, and the ballasts for the lamps are centrally located in an insulated ballast box on the roof of the building structure.

6 Claims, 4 Drawing Figures

OUTDOOR LIGHTING FIXTURE

BACKGROUND OF THE INVENTION

When outdoor surfaces are to be illuminated at night for safety and advertising purposes, it is usually desirable to illuminate the surfaces so that the surfaces are not only well-lighted but function to reflect light to surrounding areas. For example, restaurants and other retail stores that are open in the night hours usually are attractive to potential customers if the exterior vertical surfaces of the building structure are well-lighted and attractively decorated and if the parking and pedestrian area about the store building is well-lighted for purposes of parking automobiles and for customer entry and egress. While various outdoor lighting systems have been developed for these purposes, many of the systems are expensive in that they require tall poles set away from the building and expensive light fixtures mounted on the poles for illuminating parking and pedestrian areas about the building as well as the vertical sides of the building. Also, while outdoor lighting fixtures have been developed which are mounted directly on buildings and overhang the upper edge of the building for lighting the vertical sides of the building, many of the overhanging lighting fixtures function to flood certain areas of the building surface with light while adjacent areas are not well lighted, causing an un-uniform appearance to the building surface. Additionally, most of the prior art lighting fixtures of the type mounted on and overhanging a building structure are expensive to manufacture and difficult to repair.

SUMMARY OF THE INVENTION

Briefly described, the present invention comprises an outdoor lighting fixture for attachment to the upper edge of a building and the like for the purpose of uniformly illuminating the vertical side surfaces of the building structure and the adjacent pedestrian and parking areas, and which comprises an elongated continuous shade mounted along the building structure including a horizontal support section extending from the building structure in a horizontal cantilever relationship with respect to the building structure, a fold in the sheet material at the outer edge of the support section, a downwardly sloped section extending from the fold, a second fold at the outer lower edge of the downwardly sloped section, and a vertical section extending downwardly from the sloped section. A plurality of fluorescent lamp sockets are mounted to the lower surface of the horizontal support section adjacent the fold between the support section and the sloped section of the shade, and a plurality of rectilinear fluorescent lamps are supported by the sockets in alignment with one another along the length of the shade and spaced away from the vertical surface of the building structure. An elongated electrical wire housing is mounted adjacent the sockets and is rigidly mounted to the lower surface of the support section and accommodates the electrical wires for the lamps and rigidifies the shade. A plurality of support straps extend across the support section of the shade in parallel, spaced relationship with respect to one another from the building structure outwardly to the upper fold line of the shade, and together with the electrical wire housing and folds in the shade function to rigidify the shade.

Thus, it is an object of this invention to provide an outdoor lighting fixture for attachment to a building structure and the like which functions to substantially uniformly illuminate the external vertical surfaces of the building structure and to illuminate the pedestrian and parking area adjacent the building structure.

Another object of this invention is to provide an outdoor lighting fixture which is durable, inexpensive to construct, convenient to maintain, and which functions in various weather conditions to illuminate the external vertical surfaces of a building structure and the like.

Other objects, features and advantages of this invention will become apparent upon reading the following specification, when taken in conjunction with the accompanying drawings.

DETAILED DESCRIPTION

Figure 1:
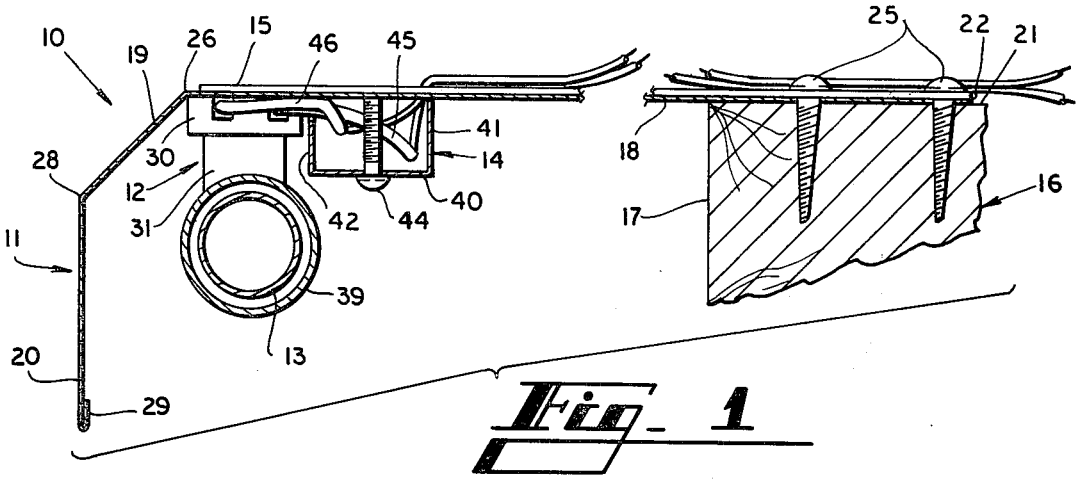
FIG. 1 is a side cross-sectional view of the outdoor light fixture, with a portion broken away.
Figure 2:
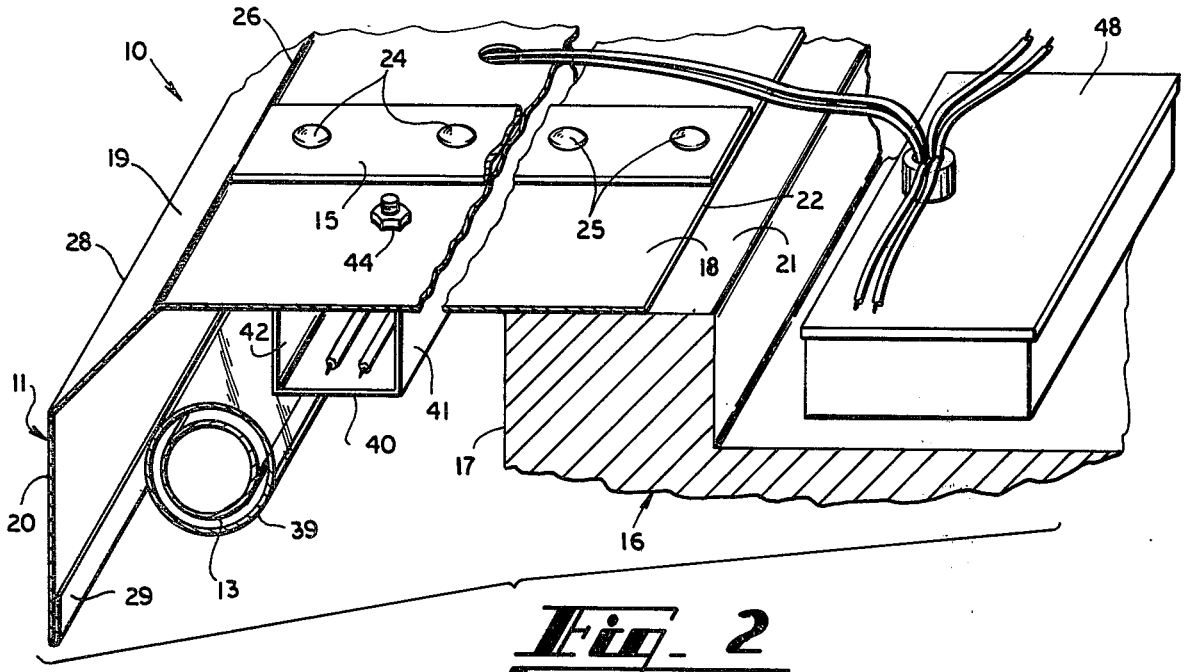
FIG. 2 is a perspective cross-sectional illustration of a portion of the light fixture.

Referring now in more detail to the drawings, in which like numerals indicate like parts throughout the several views, FIG. 1 illustrates an outdoor light fixture 10 which comprises a shade 11, lamp sockets 12, florescent lamps 13, wire housing 14, and support straps 15. Shade 11 comprises support section 18, sloped section 19, and vertical section 20. The shade 11 is fabricated from sheet material, such as galvanized aluminum, and is colored to be compatible with the color of the exterior surface of the building. The building to which the light fixture 10 is to be attached is illustrated at 16 and includes a vertical exterior surface 17 and an upper horizontal surface 21. The support section 18 of the shade 11 is substantially flat and is oriented in a horizontal attitude for attachment to the horizontal surface 21 of the building 16. The inner edge 22 of the support section 18 is spaced inwardly of the vertical edge 20 of the building, and the support section is mounted in a cantilever arrangement with respect to the building and overhangs the outside vertical surface of the building structure. The plurality of support straps 15 are rigidly connected to the upper surface of support section 18 by rivets 24, with each support strap 15 extending from the inner edge 22 of the support section 18 outwardly across the support section to the sloped section 19. Fasteners 25 extend through the inner ends of the support straps 15 and through the inner edge portion of the support section 18 down into the building 16 and support the light fixture 10 from the building structure.

Sloped section 19 extends from upper fold line 26 at an approximately 45° angle downwardly from the support section 18. The vertical section 20 extends from lower fold line 28 further downwardly parallel to the outside vertical surface of the building structure and terminates in reversed fold 29 along its lower edge.

Figure 4:
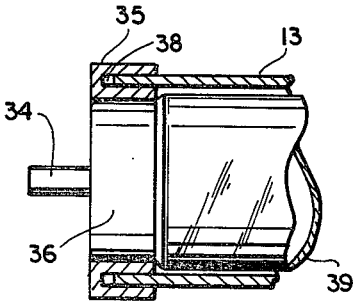
FIG. 4 is a detail of the fluorescent lamp and its external insulator.
Figure 3:
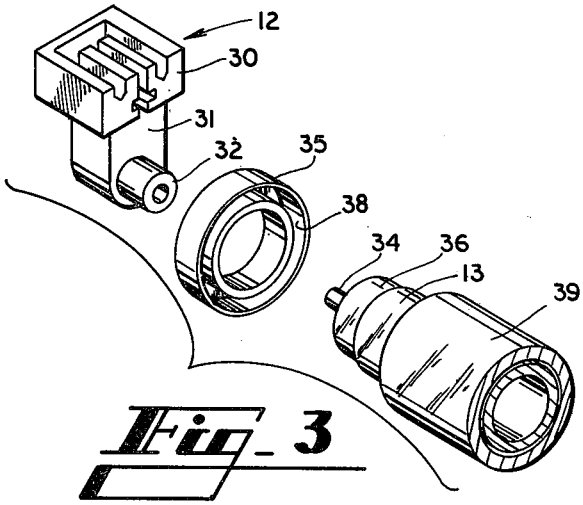
FIG. 3 is an exploded perspective illustration of the florescent lamp and a socket at the end of the lamp.

The lamp sockets 12 each include a base 30, a shank 31 and a socket or plug opening 32. The base 30 of each lamp socket 12 is mounted to the lower surface of support section 18 of shade 11 immediately adjacent the upper fold line 26, and all of the lamp sockets 12 are in alignment with one another along the length of the light fixture. The lamps 13 are all conventional rectilinear tubular fluorescent lamps and each includes male end plugs at its ends for insertion into the plug openings 32 of the spaced sockets 12. A spacer washer 35 is located at each end of each lamp 13 and is mounted on the metal end fitting 36 of the lamp. The spacer washer 35 includes an annular recess or groove 38. An external cylindrical insulator tube or shield 39 surrounds the lamp 13 and its internal diameter is larger than the external diameter of the lamp 13. The ends of shield 39 are inserted in the spacer washers 35 at each end of the lamp in the manner illustrated in FIGS. 3 and 4, and the shield is maintained in spaced relationship with respect to the lamp 13.

Wire housing 14 is rectilinear and approximately U-shaped in cross-section and includes a base section 40 and upwardly extending side sections 41 and 42. A plurality of bolts 44 at intervals along the length of the wire housing extend through the base section 40 and upwardly through the wire housing 14 and through the support section 18 of shade 11 and draw the wire housing 14 upwardly into rigid abutment with respect to the lower surface of support section 18 of the shade. The electrical wires 45 and 46 which lead to each florescent lamp 13 extend from the lamp sockets 12 through the wire housing 14, and then upwardly through the support section 18 of the shade 11, then across the top of the shade to a ballast box 48 located on the roof of the building structure. The several ballasts required to operate the fluorescent lamps 13 are located in the ballast box, and the ballast box is constructed so that it is substantially weatherproof.

The placement of wire housing 14 outwardly away from the inner edge 22 of the support section 18 of the shade 11 and closely adjacent to the lamp sockets 12, and the placement of the lamp sockets 12 closely adjacent the upper fold line 26 of the shade 11, together with the folds and the support straps 15 extending from the inner edge 22 of the support section out to the fold line 26 causes the shade 11 to be rigid at its outer end adjacent the lamp plugs 12 and lamps 13. The lamps are therefore located closely adjacent the inner surfaces of the vertical section 20, the sloped section 19 and the undersurface of the support section 18, and are spaced away from the vertical side of the building structure, so that the light emitted from the lamp 13 is emitted directly to the vertical surfaces 17 of the building structure 16, and is reflected from the inner surfaces of the shade 11 downwardly toward the vertical surfaces 17 of the building. Additionally, the presence of wire housing 14 adjacent the lamps 13 helps to reflect light emitted from the lamp downwardly toward the vertical sides of the building and to maximize illumination of the building.

While this invention has been described in detail with particular reference to preferred embodiments thereof, it will be understood that variations and modifications can be effected within the spirit and scope of the invention as described hereinbefore and as defined in the appended claims.

I claim:

1. An outdoor lighting fixture for attachment at the upper edge of a building structure and the like to a horizontal portion of the building structure, said lighting fixture comprising an elongated shade fabricated from sheet material for placement along the upper edge of the building structure including a flat, normally horizontally disposed support section attached at one of its edges in parallel overlapping fashion to the horizontal portion of the building structure and extending from said horizontal portion in an overhanging cantilever relationship beyond the upper edge of said building structure, said shade being folded down at the other edge of said support section to form a downwardly sloped section along the other edge of said support section, said shade being folded again at the lower edge of said sloped section to form a vertical section extending downwardly from the lower edge of said sloped section, a series of elongated tubular fluorescent lamps arranged in end-to-end relationship beneath said support section of said shade adjacent and in closely spaced relationship with respect to said support section, said sloped section and said vertical section, an elongated electrical wire housing extending along said shade beneath said support section adjacent said series of fluorescent lamps on the side thereof opposite to said sloped section and rigidly connected to and supported by said support section, and a plurality of elongated support braces each rigidly attached to said support section and each arranged parallel to one another and extending the full width of said support section from adjacent said one edge of said support section on the horizontal portion of the building structure to the fold between said support section and said sloped section whereby said support braces rigidify the support section in directions extending outwardly from the buildings and said elongated wire housing rigidifies the support section in directions extending along the side of the buildings.

2. The outdoor lighting fixture of claim 1 and further including a container for a plurality of ballasts for placement on top of the building structure and electrical leads extending from ballasts in said container to said fluorescent lamps.

3. The outdoor lighting fixture of claim 1 and wherein said elongated electrical wire housing is approximately U-shaped in cross-section with a lower wall section and upwardly extending side wall sections engaging the lower surface of the support section of said shade, and connectors spaced along the length of said housing and extending through the lower wall section of said housing and through the support section of said shade for drawing the wire housing tightly up against the support section of said shade.

4. The outdoor lighting fixture of claim 1 and further including a pair of lamp sockets for each lamp, with each lamp socket juxtaposed said electrical wire housing on one of its sides and juxtaposed the fold between said support section and said sloped section on the other of its sides.

5. The outdoor lighting fixture of claim 1 and further including a cylindrical shield extending about each of said elongated tubular fluroescent lamps, and a circular spacer at each end of each lamp between the lamp and the shield for maintaining said shield in spaced concentric relationship with respect to the lamp.

6. An outdoor lighting fixture for attachment at the upper edge of a building and the like to a horizontal portion of the building comprising an elongated shade formed from sheet material including an approximately flat horizontal support section attached along one of its edges to said horizontal portion of said building with said one edge of said support section extending parallel to and overlying said horizontal portion of the building, said support section of said shade extending from and overhanging the building beyond said upper edge of said building, said shade being folded downwardly to form an upper fold line approximately parallel to said one edge of said support section and forming a downwardly sloped section, said shade being folded downwardly again to form a lower fold line approximately parallel to said upper fold line and forming a vertical section extending downwardly from said sloped section, a series of pairs of fluorescent lamp sockets placed in alignment with one another and spaced along the length of said shade with each lamp socket mounted to the lower surface of said support section adjacent said upper fold, a series of elongated tubular fluorescent lamps plugged into said sockets and supported by said sockets closely adjacent the sloped section of said shade, an elongated electrical wire housing mounted to the lower surface of said support section and extending approximately parallel to the folds in said shade and positioned adjacent said sockets, and said support section including rigidifying means extending the full distance across the length of said support section from the upper fold to the other edge of said support section, said rigidifying means being rigidly attached to the building structure and clamping the overlapping portion of said support section to the horizontal portion of the building structure, whereby said rigidifying means rigidify the horizontal support section in directions extending outwardly from the buildings and said elongated wire housing rigidifies the horizontal support section in the direction extending along the side of the building.

* * * * *